US006863042B2

(12) United States Patent
Oh

(10) Patent No.: US 6,863,042 B2
(45) Date of Patent: Mar. 8, 2005

(54) LUBRICATION SYSTEM FOR THE TIMING CHAINS OF AN AUTOMOTIVE V-TYPE ENGINE

(75) Inventor: Chung-Han Oh, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/443,899

(22) Filed: May 21, 2003

(65) Prior Publication Data

US 2004/0060534 A1 Apr. 1, 2004

(30) Foreign Application Priority Data

Sep. 27, 2002 (KR) ..... 2002-58772

(51) Int. Cl.[7] ..... F01L 1/02
(52) U.S. Cl. ..... 123/196 R
(58) Field of Search ..... 123/196 R, 90.33; 184/15.3, 11.3

(56) References Cited

U.S. PATENT DOCUMENTS 3,687,231 A * 8/1972 Scheiterlein ..... 184/6.5
4,944,264 A * 7/1990 Murasaki et al. ..... 123/195 C
4,974,561 A * 12/1990 Murasaki et al. ..... 123/90.31
5,092,292 A 3/1992 Iguchi et al.
5,094,201 A * 3/1992 Bedi ..... 123/196 R
5,148,784 A 9/1992 Hiraoka et al.
5,419,742 A 5/1995 Shimaya
5,669,839 A * 9/1997 Graf et al. ..... 474/91
6,173,689 B1 * 1/2001 Tanaka ..... 123/90.34
6,260,533 B1 7/2001 Tanaka
6,520,139 B1 * 2/2003 Kobayashi ..... 123/196 R
2002/0035981 A1 3/2002 Kobayashi
2002/0035982 A1 3/2002 Kobayashi et al.
2002/0056426 A1 5/2002 Kobayashi
2002/0129782 A1 9/2002 Kawamoto et al.

FOREIGN PATENT DOCUMENTS

DE WO 02/066795 A1 1/2002

* cited by examiner

*Primary Examiner*—Henry C. Yuen
*Assistant Examiner*—Jason Benton
(74) *Attorney, Agent, or Firm*—Morgan Lewis & Bockius LLP

(57) ABSTRACT

A lubrication system for the timing chains of a V-type engine includes an oil supply means supplied by a single oil supply source. The oil supply means receives oil from a single spouting hole of a single main oil gallery and simultaneously supplies the oil to two timing chains, one of the left bank and the other of the right bank. Thereby the bulk of the cylinder block is reduced and the design and layout of the peripheral elements of the cylinders is simplified.

8 Claims, 4 Drawing Sheets

LUBRICATION SYSTEM FOR THE TIMING CHAINS OF AN AUTOMOTIVE V-TYPE ENGINE

FIELD OF THE INVENTION

The present invention relates to a lubrication system for the timing chains of an automotive V-type engine. More particularly the present invention relates to a system for lubricating the independent timing chains of the left and right banks of an engine simultaneously, from a single oil supply means.

BACKGROUND OF THE INVENTION

Typically, a timing chain is installed between the crankshaft sprocket and camshaft sprocket of a vehicular engine to facilitate rotation of the camshaft. The cylinder block has a projecting portion that functions to supply oil to the timing chain. This projecting portion is typically a small projection of the cylinder block that provides a passageway for oil from the main oil gallery to the timing chain. Furthermore, the spouting hole of the projection is directed toward the timing chain and the crankshaft sprocket. Additionally, the timing chain is maintained under constant tension by a tension arm that is pivotally installed on the cylinder block. Additionally, there is a guide arm for guiding the revolving timing chain. Accordingly, the oil supply means, by spouting the oil onto the friction portion between the timing chain and the crankshaft sprocket, provides the lubricant for the tension adjuster during the actuation of the timing chain.

In a typical V-type engine, two timing chains are connected to the crankshaft sprocket and two separate lubricating devices are required. Typically, the timing chain and crankshaft sprocket are lubricated by independent spouting holes. A drawback of this configuration is that two oil galleries are required to supply the two spouting holes. Another drawback is that the bulk of the cylinder block has to be increased, thereby increasing the amount of processing work for the increased bulk of the cylinder block. Further, the positions of the peripheral elements such as the passages of the cooling water and the cylinder liners have to be designed so as to avoid interference with the main galleries.

SUMMARY OF THE INVENTION

Embodiments of the present invention provide a lubrication system for the timing chains of an automotive V-type engine in which two oil supply means share a single spouting hole. The two oil supply means simultaneously supply the oil from a single main oil gallery to timing chains of the left and right banks.

In accordance with one embodiment of the present invention the lubrication system for the timing chains of a V-type engine receives engine oil from the main oil gallery of a cylinder block and spouts the oil onto the timing chains. The system includes an oil supply means of a single oil supply source. The oil supply means of the single oil supply source comprises a first oil jet adaptor for lubricating the timing chain of the right bank and a second oil jet adaptor, communicating through a tubular connection path to the first oil jet adaptor, for lubricating the timing chain of the left bank.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE PREFERRED EMBODIMENT

Figure 1:
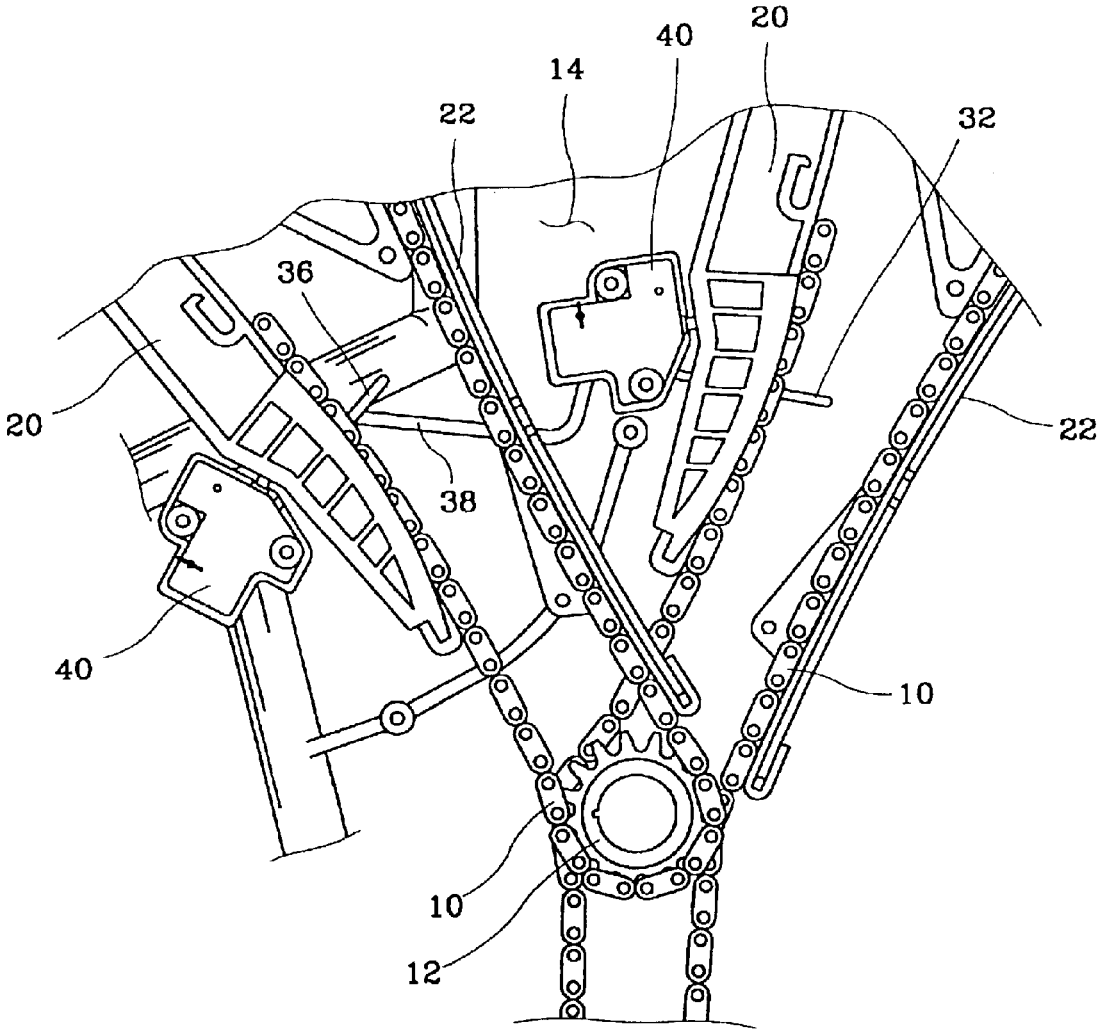
FIG. 1 is a perspective view showing an embodiment of the lubrication system for the timing chains of a V-type engine according to the present invention installed on an engine.
Figure 2:
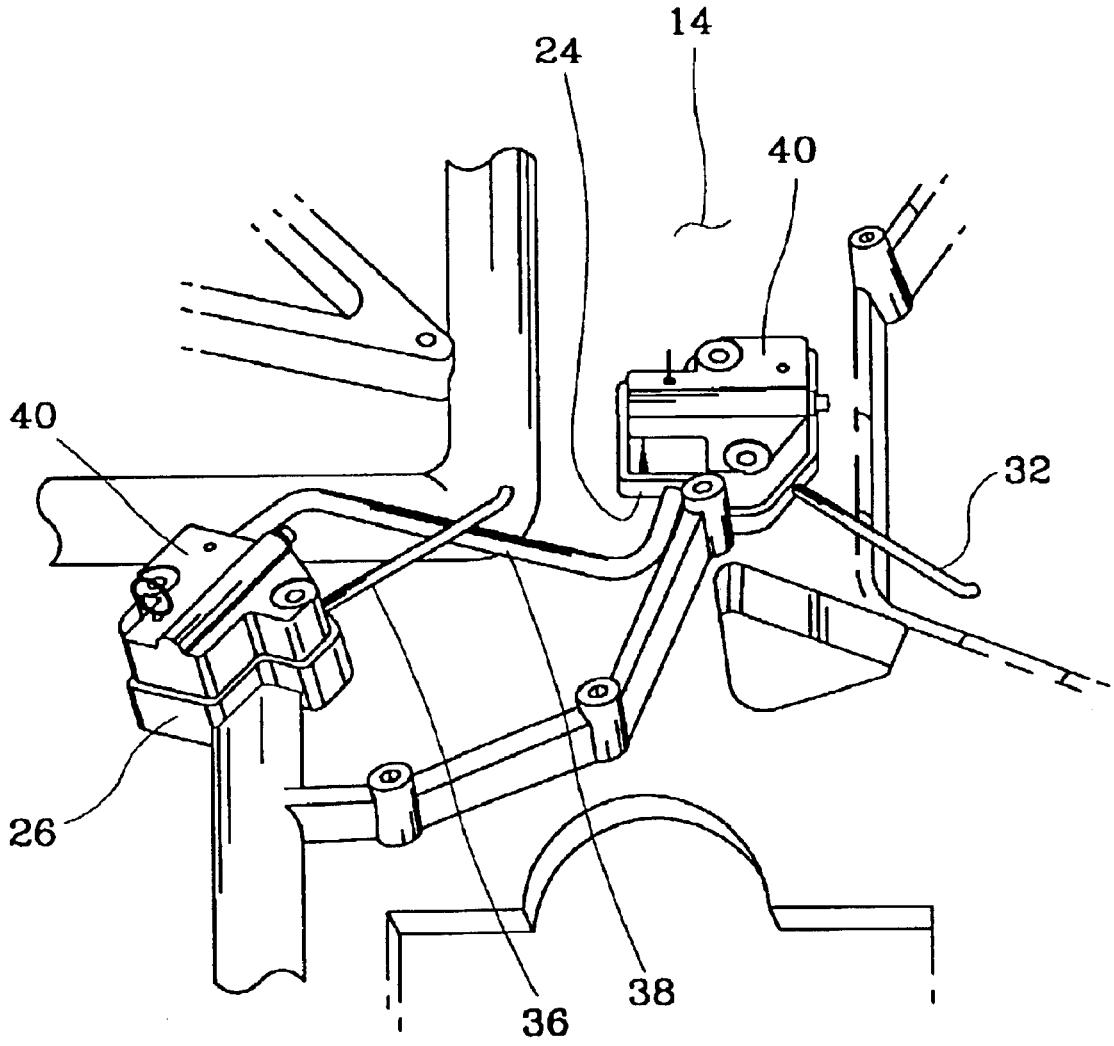
FIG. 2 is a perspective view showing an embodiment of the lubrication system for the timing chains of a V-type engine according to the present invention.

Referring to FIGS. 1 and 2, two timing chains 10 are installed between a crankshaft sprocket 12 and two camshaft sprockets (not illustrated) to transmit the revolution power from the crankshaft to the two camshafts. Positioned on the cylinder block 14 near where the crankshaft sprocket 12 is installed, there is provided an oil supply means of a single supply source for individually lubricating the two timing chains 10 of the left and right banks.

Figure 3:
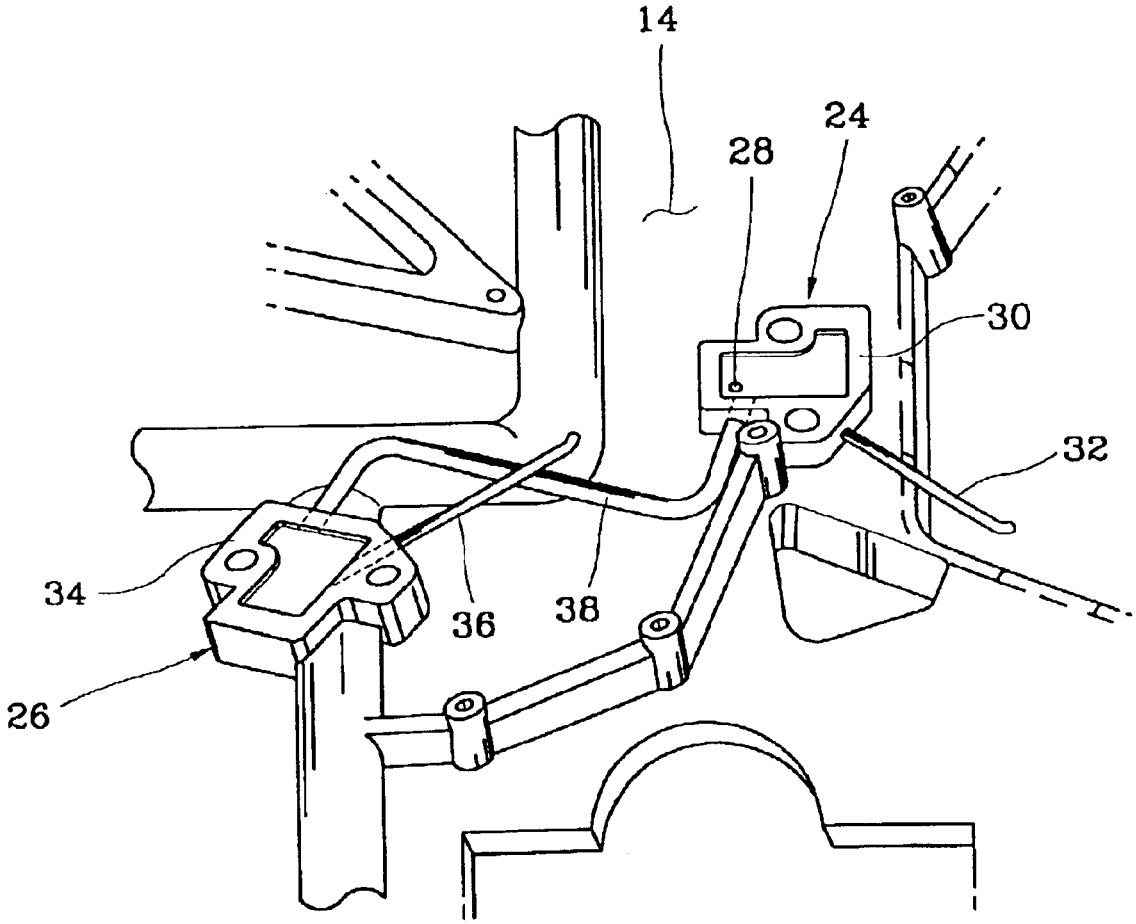
FIG. 3 is a perspective view of some of the components of the lubrication system for the timing chains of a V-type engine according to an embodiment of the present invention.

As shown in FIG. 3, the single oil supply means includes a first oil jet adaptor 24 that communicates with the main oil gallery of the cylinder block 14 and lubricates the timing chain 10 of the right bank. The second oil jet adaptor 26 communicates with the first oil jet adaptor 24 through a tubular connection path 38 for lubricating the timing chain 10 of the left bank.

The first oil jet adaptor 24 includes a first mounting part 30 that projects toward the front center of the cylinder block 14 and is connected to the main oil gallery of the cylinder block 14. A first spouting pipe 32 extends from the first mounting part 30 toward the timing chain 10 of the right bank. The first spouting pipe 32 provides the conduit to provide oil for lubricating the right timing chain. The second oil jet adaptor 26 includes a second mounting part 34 that projects toward the side front of the cylinder block 14. A second spouting pipe 36 extends from one side of the second mounting part 34 toward the timing chain 10 of the left bank to deliver oil for lubricating the left timing chain. A tubular connection path 38 inter-connects the first oil jet adaptor 24 and the second oil jet adaptor 26. Thus, the engine oil is spouted to the timing chains 10 of the left and right banks, thereby properly lubricating the area between the crankshaft sprocket 12 and the timing chains 10.

Further, in each of the first and second mounting parts 30 and 34, there is formed a recessed oil accommodation space.

Figure 4:
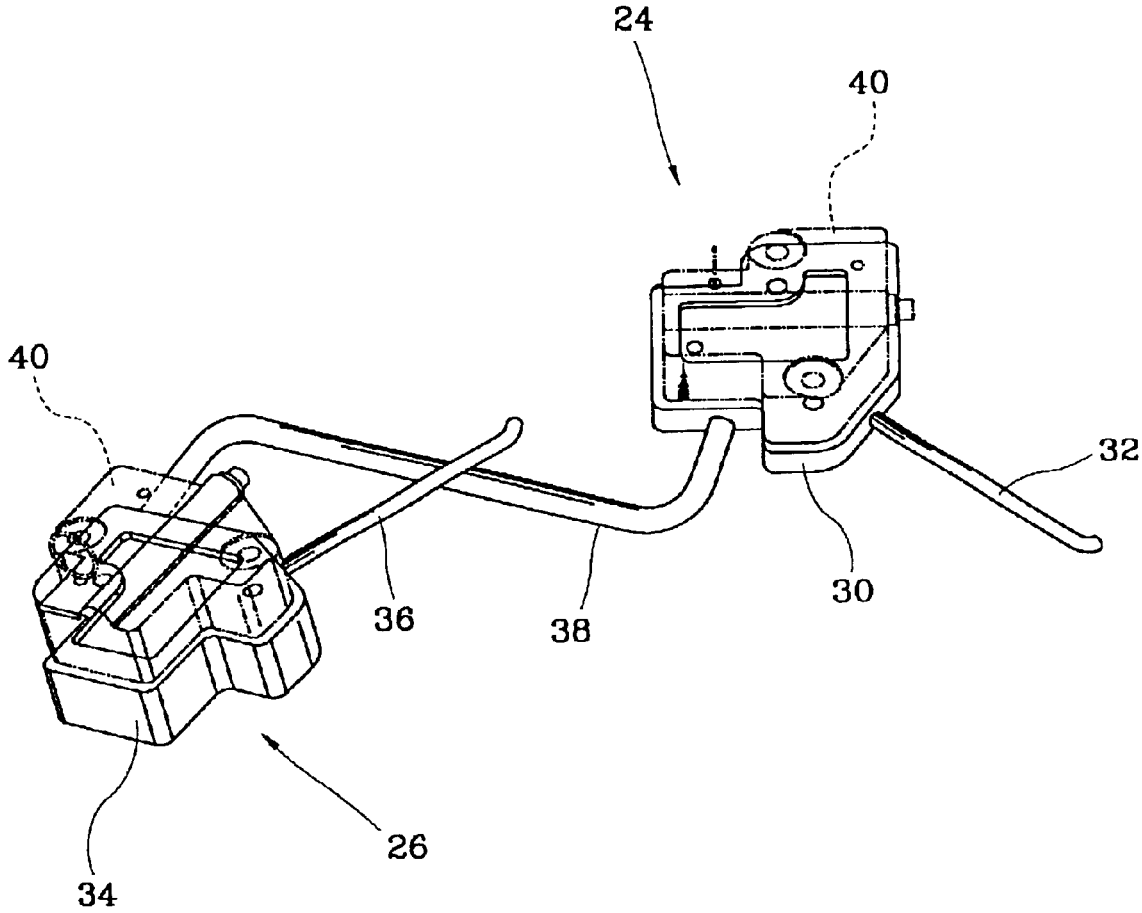
FIG. 4 is a perspective view showing an embodiment of the lubrication system, separate from the engine, according to the present invention.

According to FIGS. 2 and 4, the first and second oil jet adaptors 24 and 26 are respectively provided with automatic tensioners 40 for automatically adjusting the tensions of the timing chains 10. The automatic tensioners 40 adjust the tensions of the timing chains 10 by receiving the power from the oil of the first oil jet adaptor 24 and the second oil jet adaptor 26, respectively. Additionally, according to FIG. 1, there is a tensioner arm 20 that provides a constant tension to the timing chains 10 positioned outside the timing chains 10 of the left and right banks. The tensioner arm 20 is pivotally installed on the cylinder block 14. There is further installed a guide arm 22 for guiding the revolving timing chains 10.

The engine oil which has been spouted to the timing chains 10 of the left and right banks naturally flows downward, due to gravity, and is collected in an oil pan (not illustrated). The oil pan is assembled at the bottom of the cylinder block 14. The engine oil collected in the oil pan is recycled into the main oil gallery of the cylinder block 14 by an oil pump driven off the power of the crankshaft.

What is claimed is:

1. A lubrication system for timing chains of a V-type engine, said system receiving engine oil from a main oil gallery of a cylinder block to spout the oil to the timing chains and including an oil supply means comprising:

a first oil jet adaptor for lubricating the timing chain of a bank by communicating with said main oil gallery of said cylinder block wherein said first oil jet adaptor includes a first mounting part projecting to the front center of said cylinder block and connected to said main oil gallery of said cylinder block and a first spouting pipe extending from said first mounting part toward said timing chain of a bank; and a second oil jet adaptor communicating through a tubular connection path to said first oil jet adaptor for lubricating the timing chain of another bank wherein said second oil jet adaptor includes a second mounting part projecting to a side front of said cylinder block and connected through a tubular connection path to said first mounting part and a second spouting pipe extending from a side of said second mounting part toward said timing chain of another bank.

2. The lubrication system as claimed in claim 1, further comprising: automatic tensioners installed on said first mounting part of said first oil jet adaptor and on said second mounting part of said second oil jet adaptor respectively, for adjusting the tensions of said timing chains of the left and right banks.

3. A timing chain oiling system for a V-type engine, comprising:

a first oil jet adaptor in fluid communication with a main oil gallery of the engine; and a second oil jet adaptor;

wherein said second oil jet adaptor is in fluid communication with said first oil jet adaptor but not in direct fluid communication with the main oil gallery and wherein said first and said second oil jet adaptors are configured and dimensioned to deliver oil to a first and a second timing chain, respectively, of the engine.

4. The oiling system of claim 3, further comprising:

at least one spouting pipe extending from said first oil jet adaptor configured and adapted to deliver oil to a timing chain; and at least one second spouting pipe extending from said second oil jet adaptor configured and dimensioned to deliver oil to another timing chain.

5. The oiling system of claim 4, further comprising, automatic tensioners coupled with said first and said second oil jet adaptors configured and dimensioned to maintain a desired tension in said timing chains.

6. A timing chain oiling system for a V-type engine, comprising:

at least two oil jet adaptors wherein a first oil jet adaptor is in fluid communication with a main oil gallery of an engine; and an oil passage extending between said oil jet adaptors such that a second oil jet adaptor is not in direct fluid communication with the main oil gallery but is in downstream fluid communication with the first oil jet adaptor such that timing chains are lubricated from a single oil source.

7. The oiling system of claim 6, wherein said at least two oil jet adaptors are configured and dimensioned to deliver oil from the main gallery of the engine to timing chains of the engine.

8. The oiling system of claim 6, wherein said oil passage is a tubular connection.

* * * * *